United States Patent [19]

Reichel

[11] Patent Number: 5,062,363

[45] Date of Patent: Nov. 5, 1991

[54] FLEXIBLE PRINTING PLATE ATTACHMENT SYSTEM

[75] Inventor: Klaus T. Reichel, Augsburg, Fed. Rep. of Germany

[73] Assignee: Man Roland Druckmaschinen AG, Offenbach am Main, Fed. Rep. of Germany

[21] Appl. No.: 640,688

[22] Filed: Jan. 14, 1991

[30] Foreign Application Priority Data

Feb. 17, 1990 [DE] Fed. Rep. of Germany ..... 4005093

[51] Int. Cl.[5] ..... B41F 1/28; B41F 21/00

[52] U.S. Cl. ..... 101/415.1; 51/364; 51/367; 51/368; 51/370; 101/379

[58] Field of Search ..... 101/415.1, 378; 51/364, 51/367, 368, 370

[56] References Cited

U.S. PATENT DOCUMENTS

| | | | |
|---|---|---|---|
| 3,234,694 | 2/1966 | Vosburg | 101/415.1 X |
| 3,276,365 | 10/1966 | Langer | 101/415.1 |
| 4,510,868 | 4/1985 | Fischer | 101/415.1 |

FOREIGN PATENT DOCUMENTS

| | | |
|---|---|---|
| 0330736 | 9/1989 | European Pat. Off. . |
| 1196213 | 7/1965 | Fed. Rep. of Germany . |
| 1561005 | 4/1970 | Fed. Rep. of Germany . |
| 3326215 | 2/1985 | Fed. Rep. of Germany . |
| 3339185 | 5/1985 | Fed. Rep. of Germany . |

*Primary Examiner*—Edgar S. Burr
*Assistant Examiner*—Moshe I. Cohen
*Attorney, Agent, or Firm*—Frishauf, Holtz, Goodman & Woodward

[57] ABSTRACT

To clamp a printing form (16), the end portions are inserted into a clamping groove (2, 3) which is formed by a channel (2) extending at an angle into the printing cylinder, and axially thereover. The channel 2 is enlarged interiorly of the plate cylinder 1 into an essentially cylindrical opening (3), for example a cylindrical bore, within which an eccentrically located spindle (4, 24) is located. Upon rotation of the spindle, it will engage the end portions of the printing plate and press it against a wall (5) which, preferably, is part cylindrical and a continuation of the circle of the spindle diameter (6, 26). The surface of the spindle may be roughened or knurled, and a support element (15, 30), resiliently retained in a radial bore, or formed as a projecting essentially cylindrical collar, engages the inner wall of the axially extending cylindrical opening or bore (3) to prevent bend-through of the spindle upon engaging the ends of a printing plate.

7 Claims, 3 Drawing Sheets

FLEXIBLE PRINTING PLATE ATTACHMENT SYSTEM

FIELD OF THE INVENTION

The present invention relates to printing machinery, and more particularly to a system to attach a flexible printing plate to a printing machine cylinder formed with an attachment groove, and especially to the arrangement to retain the printing plate securely within the groove.

BACKGROUND

Various arrangements are known to clamp a flexible printing plate on the plate cylinder of a rotary printing machine, see for example, German Patent 1 196 213. A slot or groove is customarily cut into the plate cylinder, extending axially therein. A rotatable rod or spindle is, for example, located within the groove. The spindle may have a slot formed therein into which the trialing end of the printing plate can be gripped. The spindle clamps the leading edge of the printing plate against the edge of the groove. Typically, the leading edge of the plate is bent over in hook-like form. The trailing end of the printing plate is formed with a double bend. The portion forming the end region of the plate is placed in the groove or slot of the spindle.

This arrangement has a disadvantage in that the groove within the cylinder must be comparatively wide so that, upon release of the tension on the spindle, the printing plate can be readily and rapidly removed. Clamping the printing plate in the rotary spindle has an additional disadvantage in that the trailing end of the printing plate can be so deformed that re-use of the printing plate may not be possible. Such deformation may set in the printing plate and interferes with removal and re-use.

THE INVENTION

It is an object to provide an arrangement for quickly and reliably clamping a flexible printing plate on a printing cylinder, in which the trailing end of the printing plate need not be bent substantially, but, rather, only at an obtuse angle, and in which the groove formed in the cylinder can be narrow, no wider than just over twice the thicknesses of the ends of the printing plate; and which permits clamping of the flexible printing plate without essential deformation thereof, and permitting re-tightening as well.

Briefly, the groove of the printing plate is formed as an axially extending channel which intersects the tangential region of a cylindrical opening formed within the cylinder, for example a cylindrical bore. An eccentrically supported retaining spindle is located in the cylindrical opening, in a position to engage the end portions of the printing plate and press them against the wall of the insertion slot or groove.

The arrangement can be used to clamp printing plates and other flexible elements on a cylinder. It has numerous advantages in that, primarily, the printing plate, at the trailing end, will not be permanently deformed and need be bent only about an obtuse angle, so that it can be readily re-used. This is particularly important when there are frequent changes in printing jobs. Further, it is readily possible to tighten the printing place in case it came loose, and re-tighten it; after each removal, the same printing plate can be easily re-inserted and tightened about the cylinder. The arrangement further permits the use of standard plates and special plates, for example plates having a reinforced bead at the end, are not necessary, which reduces the costs of the printing plate. The slot or groove, and the cylindrical opening or bore, can be easily manufactured.

DRAWINGS

DETAILED DESCRIPTION

Figure 1:
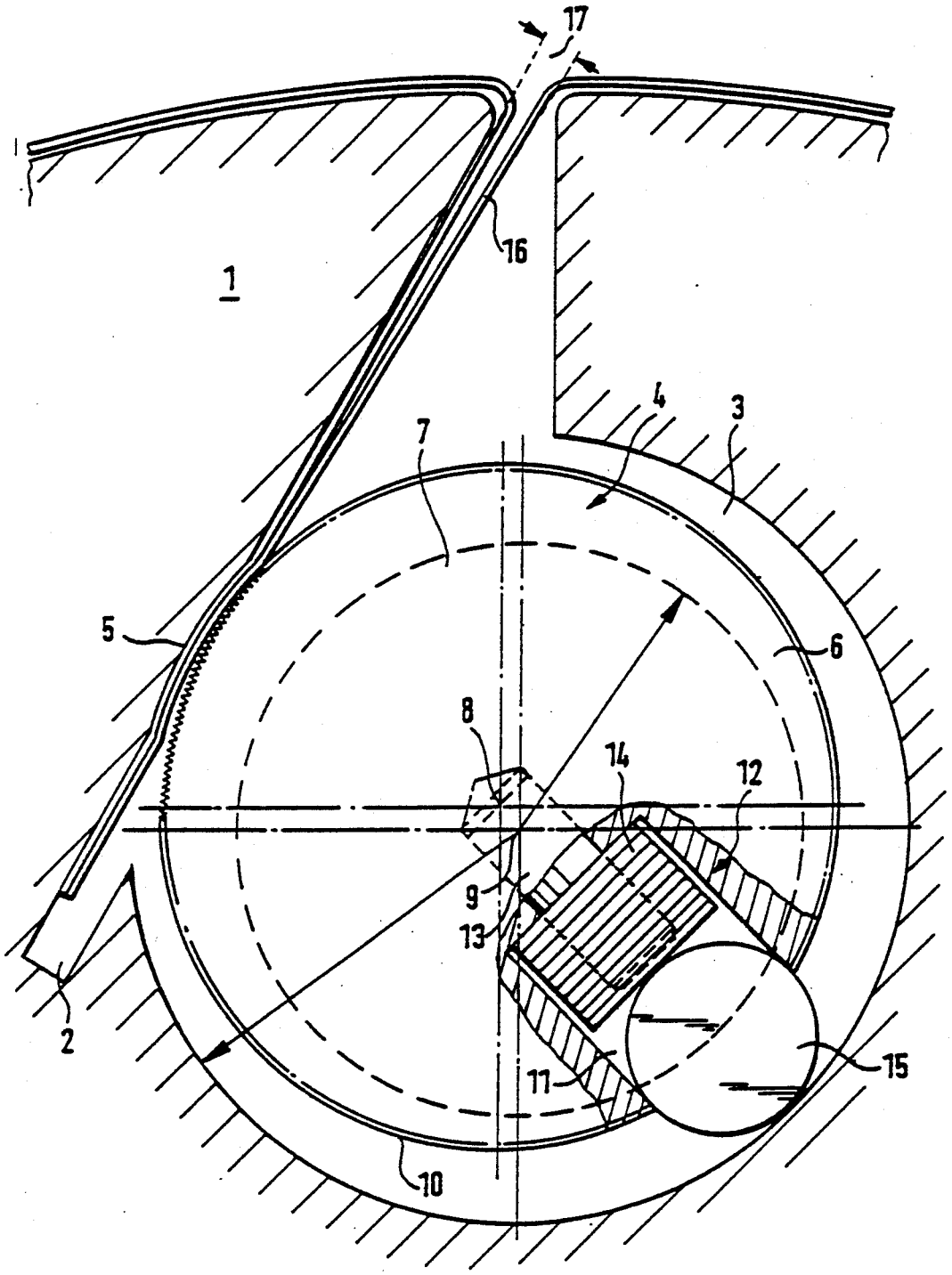
FIG. 1 is a schematic side view of a portion of a printing cylinder, and illustrating a first embodiment of an attachment system.

The cylinder 1 has a plate insertion duct portion or groove portion 2, for short, channel 2, and a duct channel or bore 3, extending parallel to the axis of the cylinder 1. The bore 3 is circular in cross section, thus cylindrical, and a clamping spindle 4 is located therein. The effective width of the channel 2 is shown at 17. The wall of the channel 2 has a small depression 5 therein which is part-cylindrical, and forms a segment of the circumference of the channel or bore 3.

The spindle 4 has a cylindrical spindle body 6 and a bearing pin 7. The axis 8 of the spindle body 6 is offset with respect to the axis 9 of the bearing stubs 7, at both ends of the spindle. The spindle 7 is so located in the channel 3 that the axis 9 coincides with the axis of the bore 3. Consequently, spindle body 6 is eccentrically located within the bore 3. A radially extending groove or one or more radially extending bores 11 are formed in the circumferential portion 10 of the spindle 4. If a groove, or one bore, it is located preferably at least generally in the axial center of the spindle 4. The groove, bore, or grooves retain a support and positioning element 12 to prevent, and further, limit radial deflection of the spindle 4 when it is moved into clamping position. The element 12 includes a pin 13, and spring elements 14, formed by a group of disk springs. A cylindrical roller 15, parallel to the axis of the spindle 4, is located adjacent the outer circumference 10 of the spindle 4. The spring disks 14 press the cylinder 15 against the wall of the bore or channel 3, and thus counteract radial deflection of the spindle 4. The pin 13 limits any possible radial deflection of the spindle 4.

The support element 12 may be formed differently; for example, rather than using a group of stacked spring disks, a spiral spring or another elastic element may be used; or a cylindrical roller within a cage, or one or more balls may be placed against the selected spring element. If the spring is a spiral compression spring, the limits of deflection of the spindle are determined by the length of the spiral spring when it is completely compressed.

The number of such support elements located axially staggered along the spindle 4, will depend on the axial length of the spindle 4 and the forces which will result and which tend to bend the spindle on the one hand, and, on the other, consideration of lowest wear and tear of the roller element 15, which may be a cylindrical roller, a ball, or the like. The number of elements can be readily determined by experimentation or engineering calculations.

Application and stretching of a printing plate on cylinder 1

The ends of a printing plate 16 are pre-bent. The leading end is pre-bent into an acute angle; the trailing end is angled off at an obtuse angle. The so pre-bent ends are fitted in the channel 2. The spindle 4 is then rotated, for example by means of a worm gear attached to and coupled to an end thereof. The spindle body 4 grips the ends of the printing plate 16 and presses them against the particular wall portion 5 of the channel 2. As seen in FIG. 1, spindle 4 is rotated in counterclockwise (CCW) direction. Upon rotation of the spindle 4, the spindle body, which is rough at the outside, engages the ends of the printing plate 16 which, likewise, can be roughened. The inside of the channel 2 and particularly in the region of the wall portion 5, can also be left essentially unfinished and rough. Upon rotation of the spindle body 6, the two ends of the printing plate 16 are pulled into the channel 2 and, at the same time, clamped therein. Surface roughness on the spindle body 6 can be obtained either by leaving a machined spindle body unfinished or, separately, knurling the spindle body where it engages the plate 16.

Figure 2:
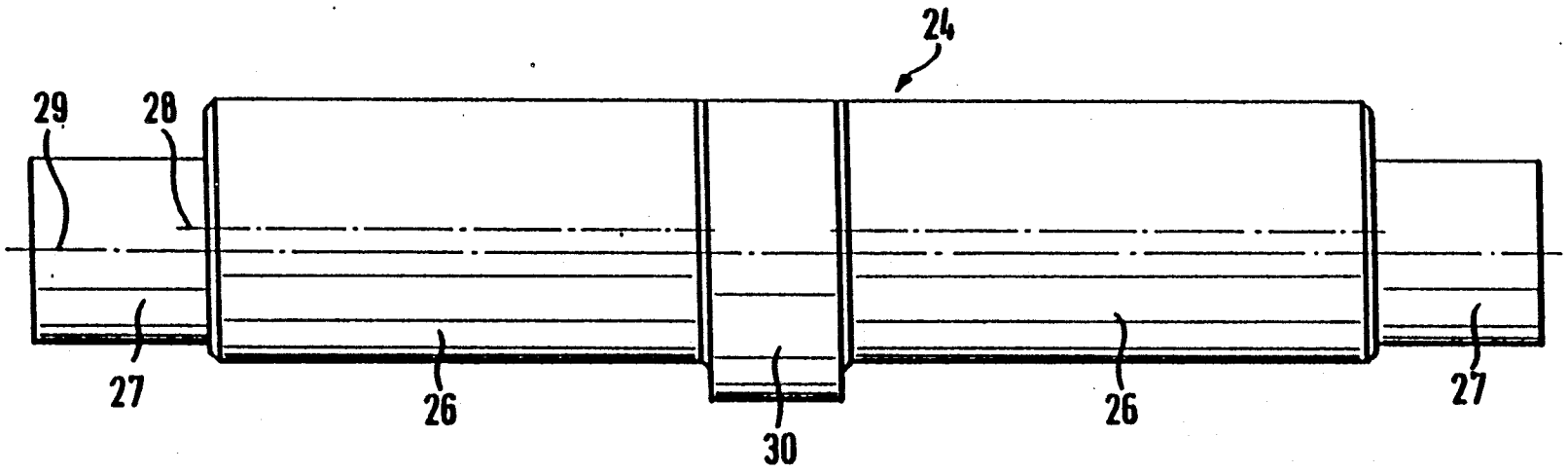
FIG. 2 is a schematic front view of another embodiment of a spindle for use in a modified embodiment of the printing system.

FIG. 2 illustrates, in schematic side view, a clamping spindle in accordance with another embodiment. The duct 3, wall 5, and the plate cylinder 1 can all be identical to that shown in FIG. 1. Hence, the embodiment of FIG. 2 has omitted this portion of the drawing. The operation and clamping effect is the same as that described in connection with FIG. 1.

The clamping spindle 24 has a spindle body 26, bearing stubs 27 and a support portion 30 formed on the spindle body. The axis 28 of the spindle body 26 is offset with respect to the axis 29 of the bearing pins 27, so that the spindle 24 functions as an eccenter. The engagement portion 30 is cylindrical, with a central axis which corresponds to the axis of rotation 29 of the bearing pins 27. The diameter of the support portion 30 is so dimensioned that it can slidably fit within the duct 3, that is, is rotatable in the duct 3.

Usually, a single support region 30 will completely prevent bend-through of a spindle 24; if the spindle 24, however, is quite long, or the clamping or deflection forces are substantial, a plurality of such support regions 30 may be provided to prevent wear and tear on the support portions 30 and the engaged wall portions of the duct 3. The width of the respective support portions 30, in dependence on the number of support portions, the length of the spindle 24, materials used and the like.

To apply a printing plate 16, it is first placed into the groove, that is, the channel 2, and the spindle 24, having first been introduced, is rotated, for example by a worm gear, such that the eccentrically positioned spindle body 26 grips the plate 16 at both ends and pulls it into the channel 2 and then clamps it in position at the part-circular portion 5 of the channel 2. To permit unlimited rotation of the spindle 24, and, particularly, to avoid damage to the printing plate 16 if the engagement portion 30 should engage the printing plate 16, one or the other of the following precautions are suitable: Either, the ends of the printing plate 16 are formed with a cut-out into which the support portions 30 can be rotated when clamping the printing plate; or, alternatively, the surface of the portion 30 extending from the spindle body is formed with flattened portions 32, which can fit against the printing plate 16, so that no cut-out in the printing plate 16 is necessary. The flattened portions 32, preferably, are so dimensioned on the spindle, and include such an angle that, upon clamping the spindle 24, and subsequently loosening it, only a quarter rotation by the spindle is required.

Figure 3:
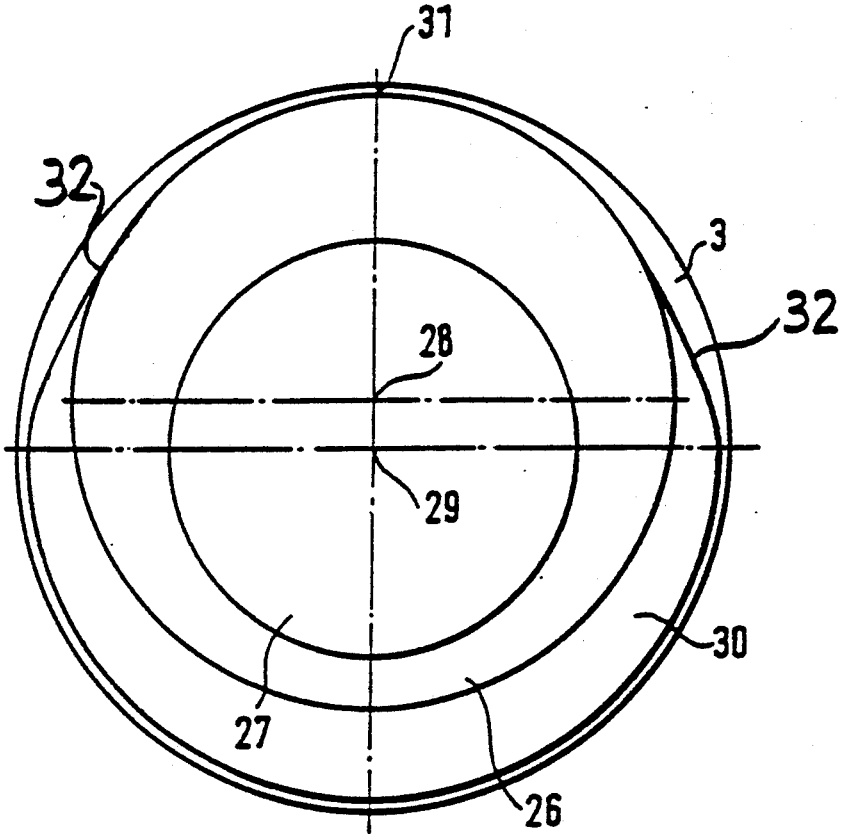
FIG. 3 is a schematic end view of the spindle of FIG. 2.

FIG. 3 illustrates the spindle 24 shown in FIG. 2 with the flattened regions 32 thereon. The figure is drawn highly schematically and exaggerated, particularly to show the flattened portions 32 of the support portion 30. As clearly seen in FIG. 3, the support portion 30, starting from the position indicated at 31, where the circumference of the support portion 30 and the circumference of the spindle portion 26 adjoin each other, is flattened outwardly in both directions over a range of about 90°.

The arrangement in accordance with the present invention has a number of advantages:

The printing form 16 need not be permanently deformed; only an obtuse angle need be pre-bent, which can be readily straightened or bent again;

the width 17 of the channel 2 can be reduced to only slightly more than double the thickness of the printing form 16; nevertheless, the ends of the printing form 16, upon release from the spindle, can be readily pulled out of the channel 2;

extreme deformation of the ends of the printing forms, as was usual with prior art structures, do not occur when using the structure of the present invention, so that the printing form can be re-used numerous times; this is of particular importance when the subject matter to be printed changes frequently, and a substantial economic factor;

the printing form can readily be re-tensioned or re-tightened, and tensioning and tightening is simple, particularly after the printing form has been once used, or already re-used;

a rough surface of the spindle 4, 24, respectively, provides for reliable clamping of the printing form over a large angular range, and reliable holding within the part-cylindrical segment 5;

no special printing plates need be provided; thus, printing plates which have end beads, for example by including a beaded wire in the end portions, are not necessary; this, again, is of substantial economic importance; and the opening or channel or bore 3, as well as the channel 2, can be readily formed in any cylinder; particularly, the opening 3 can be formed as a through-bore, and the channel 2 made easily by an axially moving milling cutter.

Various changes and modifications may be made, and any features described herein may be used with any of the others, within the scope of the inventive concept.

I claim:

1. Flexible printing plate attachment system having a plate cylinder (1) formed with a clamping groove (2, 3) for placement of end portions of a flexible printing plate (16) therein, wherein, in accordance with the invention, the clamping groove includes a cylindrical opening (3) extending axially in the cylinder (1), and an insertion channel (2) defining a channel wall (5), said channel wall intersecting the cylindrical opening at a tangential region thereof; and wherein an eccentrically retained spindle (4) is located in said cylindrical opening (3) and positioned for engagement against said end portions of the flexible printing form (16) and, selectively, to press the end portion against said channel wall upon rotation of said eccentrically retained spindle within the cylindrical opening, wherein said channel wall has a part-cylindrical portion which forms a portion of the circumferential circle of said cylindrical opening.

2. The system of claim 1, further including a support element (12, 30) on the spindle (4) to limit radial deflection thereof upon engagement with the end portions of the printing form (16), said support element (12, 30) being engageable against a wall of said cylindrical opening (3).

3. The system of claim 1, wherein the spindle (4) comprises two bearing stubs or pins (6) extending parallel to the axis of the spindle; and a support element is provided extending radially from the spindle body (6) at a position intermediate the bearing pins or stubs (7), said support element being radially resiliently engaged against a wall of the cylindrical opening (3).

4. The system of claim 3, wherein said support element comprises a rotatable element (15) engageable with said wall of the cylindrical opening;

a radial recess formed in the spindle;

and spring means (14) located in said radial recess and pressing said rotatable element (15) against the wall of said cylindrical opening.

5. The system of claim 1, wherein said spindle (4) includes bearing pins or stubs (27) and a spindle body (26) extending eccentrically with respect to said bearing pins or stubs;

and a support element (30) is provided, formed as a cylindrical portion (30) of said spindle having a cylinder center coaxial with said bearing pins or stubs (27) and located axially slidably within said axially extending cylindrical opening (3).

6. The system of claim 5, wherein said cylindrical portion (30) is formed with at least one flattened surface region (32).

7. The system of claim 6, wherein said flattened surface region extends over an angle of about 90° starting from a surface portion or point (31) at which the circumference of said cylindrical portion coincides with the circumference of the spindle body other than said cylindrical portion.

* * * * *